US008572885B2

(12) United States Patent
Karagias

(10) Patent No.: US 8,572,885 B2
(45) Date of Patent: Nov. 5, 2013

(54) MOUNTING CLAMPS FOR COUPLING SCOPES TO MOUNTING RAILS OF FIREARMS

(76) Inventor: Theodore Karagias, Seattle, WA (US)

( * ) Notice: Subject to any disclaimer, the term of this patent is extended or adjusted under 35 U.S.C. 154(b) by 10 days.

(21) Appl. No.: 13/005,480

(22) Filed: Jan. 12, 2011

(65) Prior Publication Data

US 2011/0271578 A1 Nov. 10, 2011

Related U.S. Application Data

(60) Provisional application No. 61/294,407, filed on Jan. 12, 2010.

(51) Int. Cl.
*F41G 1/387* (2006.01)

(52) U.S. Cl.
USPC ..... 42/124

(58) Field of Classification Search
USPC ..... 42/124, 125, 126, 127, 128, 119
See application file for complete search history.

(56) References Cited

U.S. PATENT DOCUMENTS

| | | | | |
|---|---|---|---|---|
| 2,018,960 | A | 10/1935 | Kuhn | 33/50 |
| 2,425,130 | A | 8/1947 | Shelley | 42/1 |
| 2,493,254 | A | 1/1950 | Leupold | 33/50 |
| 2,510,289 | A | 6/1950 | Livermore | 33/50 |
| 2,545,419 | A | 3/1951 | Williams | 33/50 |
| 2,597,466 | A | 5/1952 | Felix | 33/50 |
| 2,717,447 | A | 9/1955 | Leupold | 33/50 |
| 2,743,525 | A | 5/1956 | Leupold | 33/50 |
| 2,782,511 | A | 2/1957 | Ivy | 33/50 |
| 2,803,880 | A | 8/1957 | Weaver | 33/50 |
| 2,803,907 | A | 8/1957 | Weaver | 42/1 |
| 2,857,675 | A | 10/1958 | Kesseiring | 33/50 |
| 2,937,448 | A | 5/1960 | Dimick | 33/50 |
| 3,253,361 | A | 5/1966 | Kingsbury | 42/1 |
| 3,295,811 | A | 1/1967 | Giwosky | 248/229 |
| 3,401,460 | A | 9/1968 | Tellié | 33/50 |
| 3,463,430 | A | 8/1969 | Rubin | 248/205 |
| 3,579,840 | A | 5/1971 | Heinzel | 33/50 |
| 3,877,166 | A | 4/1975 | Ward | 42/1 S |
| 3,880,389 | A | 4/1975 | Burris | 248/205 R |
| 4,574,508 | A | 3/1986 | Ross | 42/1 ST |
| 4,688,345 | A | 8/1987 | Kilgour | 42/101 |
| 5,155,915 | A | 10/1992 | Repa | 33/247 |
| 5,433,010 | A | 7/1995 | Bell | 33/247 |
| 5,680,725 | A | 10/1997 | Bell | 42/101 |
| 5,787,630 | A * | 8/1998 | Martel | 42/125 |
| 6,026,580 | A | 2/2000 | LaRue | 33/250 |
| 6,705,037 | B2 | 3/2004 | Van Kirk | 42/126 |
| 6,722,074 | B1 | 4/2004 | Farrell | 42/124 |
| 7,272,904 | B2 | 9/2007 | Larue | 42/127 |
| 7,467,490 | B2 * | 12/2008 | Mossberg et al. | 42/77 |
| 7,562,484 | B2 | 7/2009 | Kim | 42/114 |
| 7,677,755 | B2 | 3/2010 | Kim | 362/190 |

(Continued)

OTHER PUBLICATIONS

Catalog Page, "Control Scope Mounts," downloaded from http://www.conetrol.com/ on Jul. 21, 2009, 3 pages.

*Primary Examiner* — Stephen M Johnson
(74) *Attorney, Agent, or Firm* — Perkins Coie LLP

(57) ABSTRACT

A sighting assembly for a firearm includes a scope and a mounting clamp. The mounting clamp includes a ring cap and a ring base that cooperate to surround and hold the scope. The mounting clamp has a rail clamp that includes a plurality of crowned portions that are configured to physically contact and grip a mounting rail.

16 Claims, 9 Drawing Sheets

(56) References Cited

U.S. PATENT DOCUMENTS

| | | | | |
|---|---|---|---|---|
| 7,730,655 | B2 | 6/2010 | Spuhr | 42/127 |
| 7,814,697 | B2 | 10/2010 | Esch | 42/85 |
| 2003/0192224 | A1 | 10/2003 | Kirk | 42/124 |
| 2004/0148842 | A1 | 8/2004 | Aalto et al. | 42/127 |
| 2006/0010758 | A1 | 1/2006 | Zeh | 42/124 |
| 2006/0123686 | A1* | 6/2006 | Larue | 42/127 |
| 2007/0266612 | A1 | 11/2007 | Kim | 42/127 |
| 2008/0022576 | A1 | 1/2008 | Epling | 42/124 |
| 2008/0034638 | A1 | 2/2008 | Spuhr | 42/127 |
| 2009/0133311 | A1 | 5/2009 | Hollenbach et al. | 42/124 |
| 2009/0288325 | A1 | 11/2009 | Esch | 42/85 |
| 2011/0023348 | A1 | 2/2011 | Karagias | 42/124 |
| 2011/0067287 | A1* | 3/2011 | Collin et al. | 42/119 |

* cited by examiner

MOUNTING CLAMPS FOR COUPLING SCOPES TO MOUNTING RAILS OF FIREARMS

CROSS-REFERENCE TO RELATED APPLICATION

This application claims the benefit under 35 U.S.C. §119 (e) of U.S. Provisional Patent Application No. 61/294,407 filed Jan. 12, 2010, where this provisional application is incorporated herein by reference in its entirety.

BACKGROUND

1. Technical Field

The present invention relates generally to mounting clamps for firearms. More specifically, the invention relates to mounting clamps capable of coupling an accessory to a mounting rail of a firearm.

2. Description of the Related Art

Telescopic sights are used in a wide range of different fields. Telescopic sights, such as scopes, are often used to aim firearms, such as rifles or handguns. A user can peer through the scope to view a target up close. Conventional scope rings for holding scopes are often coupled to accessory rails of firearms. Unfortunately, these scope rings have flat surfaces that physically contact the accessory rails and result in edge loading. FIGS. 1 and 2 show a conventional scope ring 56 that has a rail clamp 60 with flat surfaces 62, 64, 66, 68 that physically contact an accessory rail 70. The rail clamp 60 and/or accessory rail 70 can be damaged (e.g., deformed) due to high stresses, especially if the accessory rail 70 is not properly sized (e.g., undersized) with respect to the rail clamp 60. Such rail clamps thus often compromise rail engagement precision. If the scope ring is repeatedly removed and reinstalled, rail engagement precision can be significantly compromised.

BRIEF SUMMARY

At least some embodiments disclosed herein are directed to a sighting assembly with at least one mounting clamp configured to grip a telescopic sight. The mounting clamp can be coupled to a mounting rail without creating appreciable localized stresses in the mounting rail and/or mounting clamp so as to avoid or limit damage to the mounting rail and/or mounting clamp. The mounting clamp can be a scope ring or other type of clamp for holding the telescopic sight, or other type of sighting device or accessory (e.g., a handle, a bipod, sling attachment device or point, a light, etc.).

A mounting clamp has, in some embodiments, one or more crowned portions for physically contacting a mounting rail. The crowned portions cooperate to grip the rail and to minimize, limit, or substantially eliminate stress concentrations in the rail.

In some embodiments, a rail clamp includes a plurality of crowned surfaces surrounding a mounting rail channel which is sized to receive a mounting rail. The crowned surfaces can deform due to applied loads to keep stresses at or below a desired level. For example, the crowned surfaces can flatten out to keep stresses in the mounting clamp and/or mounting rail below the yield strength of the mounting clamp or the yield strength of the mounting rail, or both.

In some embodiments, a mounting clamp has one or more crowned portions positioned to engage a mounting rail. When installed, the crowned portions distribute clamping forces along a section of the rail. In certain embodiments, the crowned portions extend along most or substantially all of a length of a mounting rail channel. A mounting rail can be inserted into the mounting rail channel of the mounting clamp. In some embodiments, the crowned portions are sufficiently curved so as to elastically deform to accommodate relatively high clamping loads, thereby reducing applied stresses.

In some embodiments, a scope mounting clamp is coupleable to a firearm. The scope mounting clamp includes a plurality of deformable portions that are configured to physically contact and grip a mounting rail. Non-planar surfaces of the deformable portions help minimize, limit, or substantially eliminate edge loading. In some embodiments, the deformable portions are crowned regions of the mounting clamp surrounding a channel or opening in which the mounting rail can be placed.

The deformable portions can define V-shaped gaps, U-shaped gaps, wedge-shaped gaps, or other types of gaps for receiving edges, or other features, of the mounting rail. In certain embodiments, a pair of deformable portions defines a generally V-shaped gap that receives a portion of the mounting rail. Another pair of deformable portions defines another generally V-shaped gap for receiving another portion of the mounting rail.

A scope mounting clamp, in some embodiments, includes a clamp member and a main body. The clamp member includes a first crowned portion. The main body includes a plurality of second crowned portions. The clamp member and the main body define a mounting rail channel. The first crowned portion and the second crowned portions surround the mounting rail channel and are configured to physically contact and grip a mounting rail of a firearm when the mounting rail is positioned in the mounting rail channel.

BRIEF DESCRIPTION OF THE SEVERAL VIEWS OF THE DRAWINGS

Non-limiting and non-exhaustive embodiments are described with reference to the following drawings. The same reference numerals refer to like parts or acts throughout the various views, unless otherwise specified.

DETAILED DESCRIPTION

Figure 1:
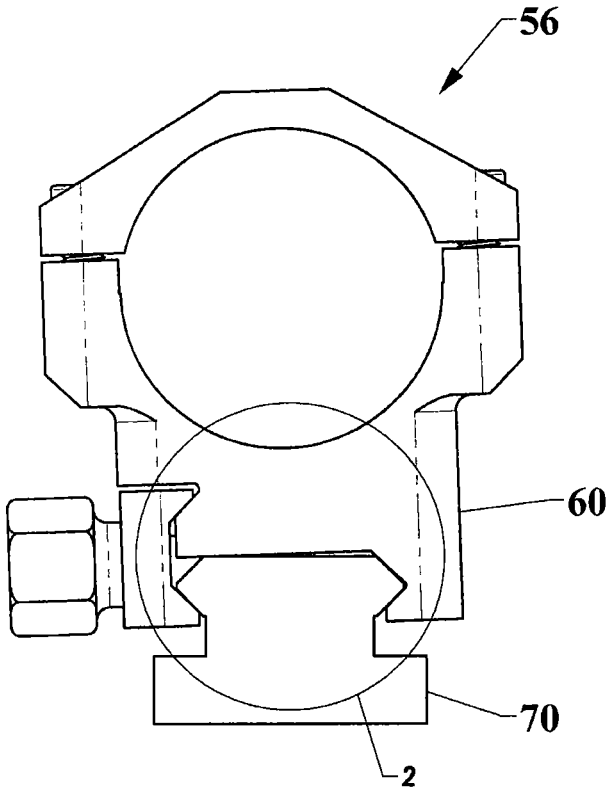
Fig. 1 Prior Art
FIG. 1 is an elevational view of a conventional scope ring coupled to an accessory rail.
Figure 2:
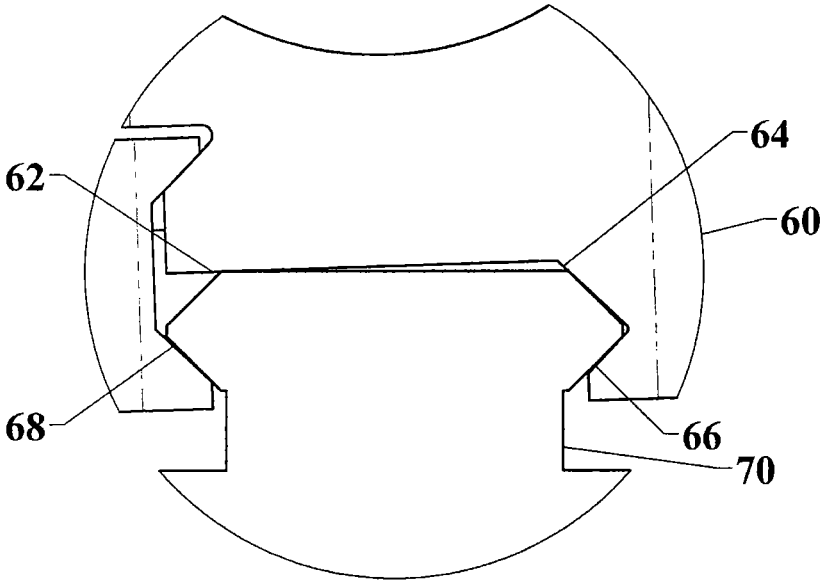
Fig. 2 Prior Art
FIG. 2 is a detailed view of a portion of the conventional scope ring and the accessory rail of FIG. 1.
Figure 3:
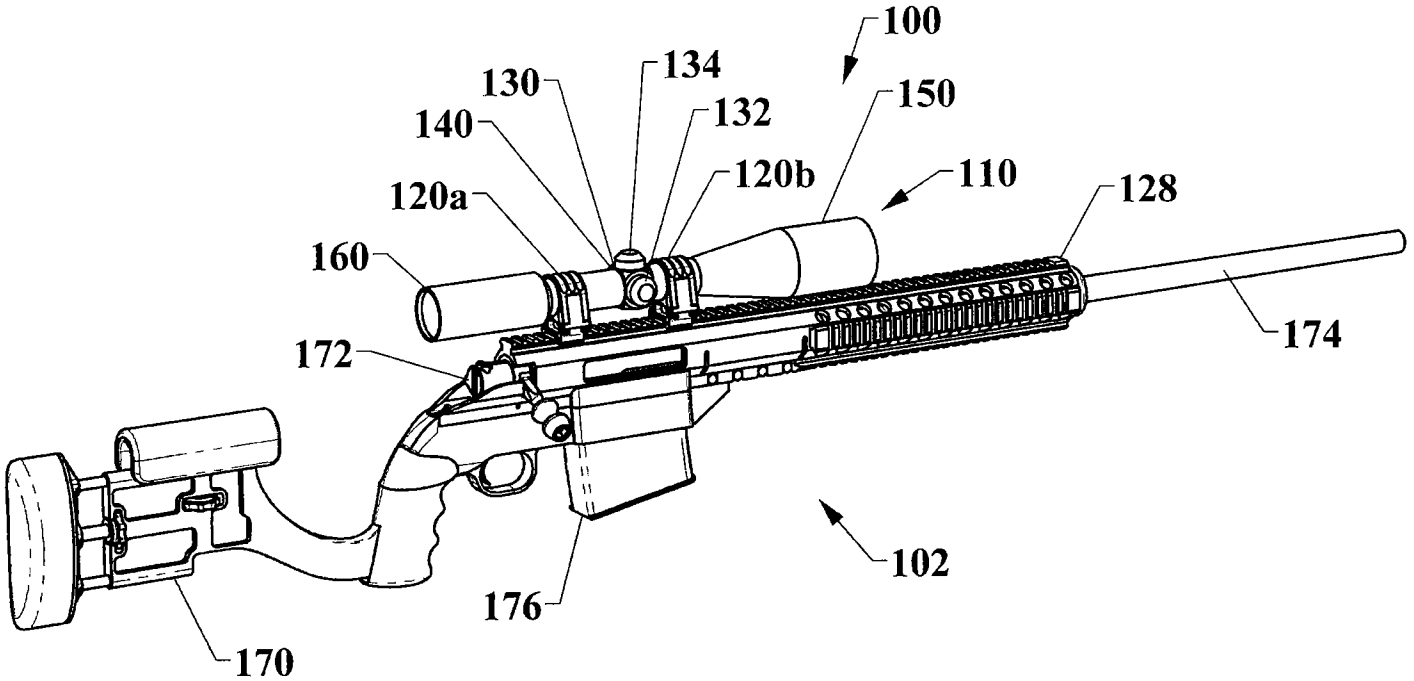
FIG. 3 is an isometric view of a firearm and a viewing assembly coupled to the firearm, in accordance with one embodiment.

FIG. 3 shows a viewing assembly 100 mounted on a firearm 102. The viewing assembly 100 includes a sight 110 and a pair of mounting clamps 120*a*, 120*b* (collectively "120"). The mounting clamps 120 are coupled to a mounting rail 128. To move the scope 110, the mounting clamps 120 can release the mounting rail 128 and can be coupled at appropriate locations along the rail 128. The mounting clamps 120 can provide relatively large clamping forces without damaging (e.g., marring, denting, bending, scratching, or otherwise permanently deforming) the clamps 120 and/or the mounting rail 128.

Figure 4:
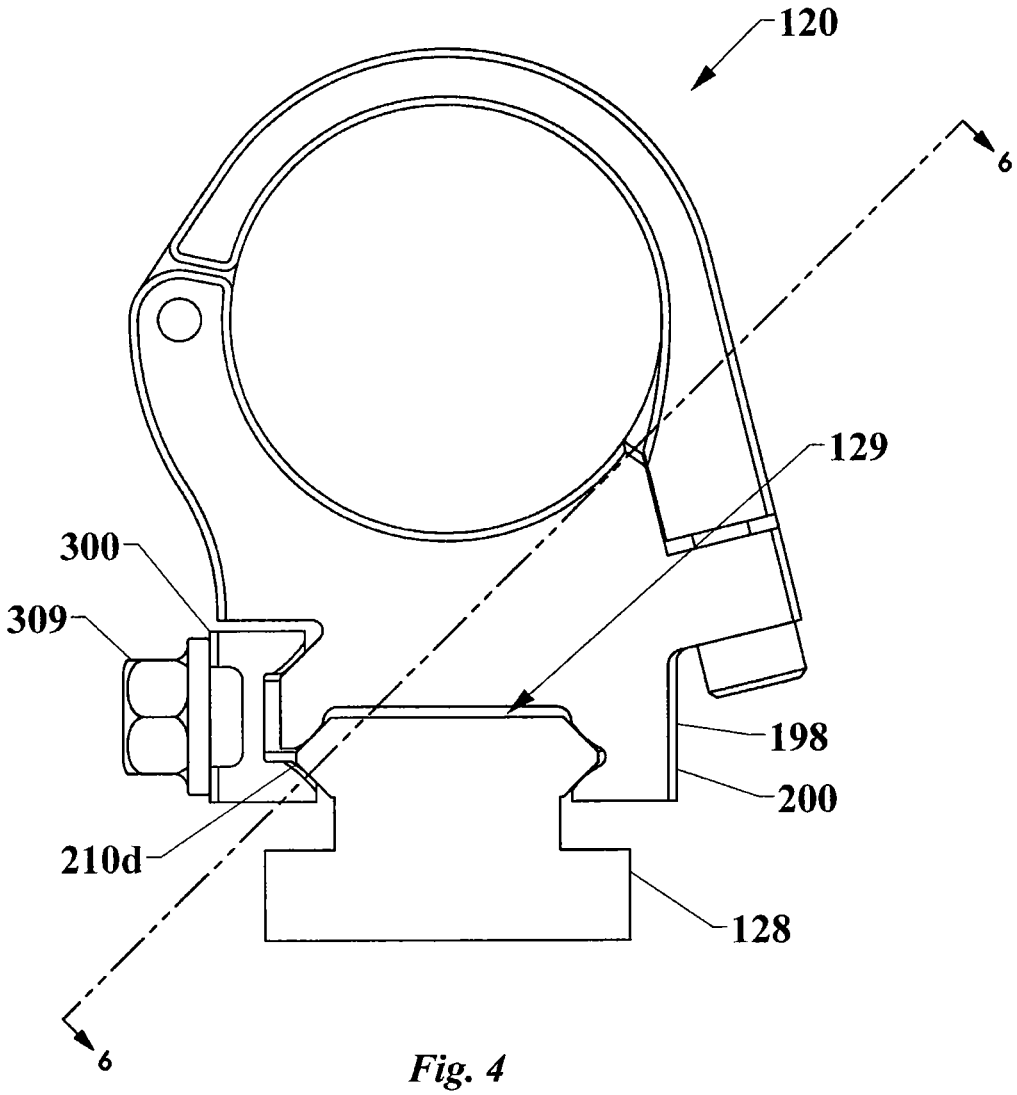
FIG. 4 is a front elevational view of a mounting clamp attached to a mounting rail.

The mounting rail 128 can be an accessory rail or other type of rail or feature to which components can be coupled. The mounting clamps 120 may be repeatedly removed and reinstalled without re-zeroing (recalibration) of firearm 102, even if the mounting rail 128 is undersized or oversized with respect to a rail channel 129 (FIG. 4).

The firearm 102 of FIG. 3 is a rifle with a butt stock 170, a firing mechanism 172, and a barrel 174. The firing mechanism 172 receives ammunition from a magazine 176. The viewing assembly 100 can be coupled to different types of firearms, such as a handgun (e.g., a pistol, a revolver, etc.), an air gun, or other type of device used to shoot projectiles, such as a crossbow.

The sight 110 can be a telescopic sight or other aiming device. Sights can include optical components, such as optical trains, objective lenses, ocular lenses, reticles, and other lenses that cooperate to provide desired viewing functionality. The sight 110 of FIG. 3 is a scope that includes a windage and elevation adjustment mechanism 130. A user may rotate dials 132, 134 to establish the desired windage or elevation setting. The illustrated adjustment mechanism 130 is positioned between the mounting clamps 120*a*, 120*b*. The scope 110 may also include other types of controls or adjustment mechanisms.

The illustrated scope 110 also includes an objective 150, an eyepiece 160, and the tubular section 140 extending between the objective 150 and the eyepiece 160. The objective 150 carries objective lenses, and the eyepiece 160 carries ocular lenses. Imaging optics (e.g., an erector assembly, zoom assembly, reticle, combinations thereof, or the like) can be within and protected by the tubular section 140. Light can propagate through the imaging optics to provide an image to the observer.

The mounting clamps 120*a*, 120*b* of FIG. 3 can be generally similar to each other. The following description of one of the mounting clamps applies equally to the other, unless indicated otherwise.

Figure 5:
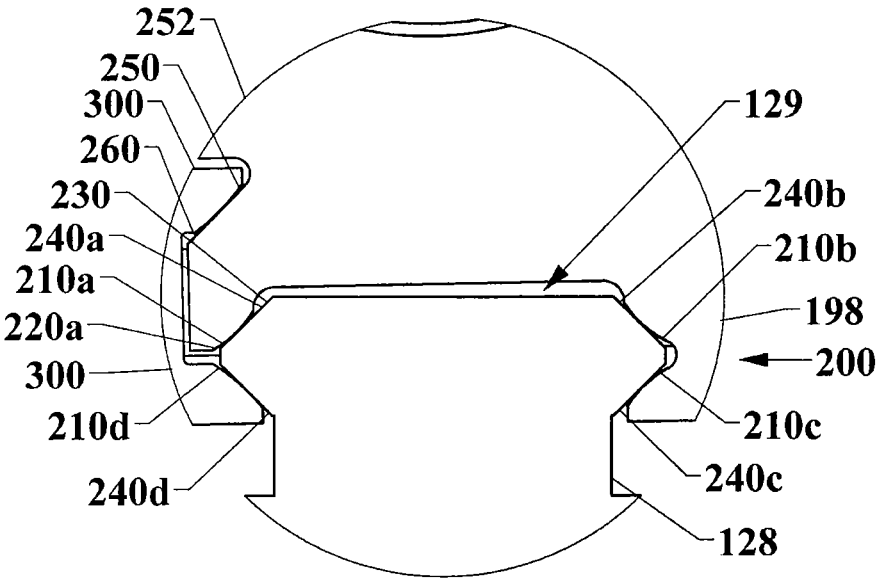
FIG. 5 is a detailed view of a portion of the mounting clamp and a portion of the mounting rail of FIG. 4.

Referring to FIGS. 4 and 5, the mounting clamp 120 includes a rail clamp 200 that can grip the mounting rail 128 while keeping stresses in the mounting rail 128 at or below an acceptable level, even if the mounting rail 128 is undersized or oversized with respect to the rail channel 129. A main body 198 of the clamp 200 and a clamp member 300 define the rail channel 129. Crowned portions 210*a*, 210*b*, 210*c*, 210*d* (collectively 210) can elastically and/or plastically deform to manage such stresses. The following description of one of the crowned portions applies equally to the others, unless indicated otherwise.

The illustrated crowned portion 210*a* includes a substantially non-planar surface 220*a* that physically engages and bears against a substantially flat surface 230 of the mounting rail 128. If clamping forces are increased, the non-planar surface 220*a* can flatten to increase the contact area to manage stresses and avoid or reduce edge loading. As such, high clamping forces can be achieved without damaging the rail clamp 200 and/or the mounting rail 128.

The crowned portion 210*a* can have a radius of curvature selected based on the size, configuration, and/or tolerances of the mounting rail 128 and, in some embodiments, based on desired contact pressures and desired load distributions. In some non-limiting embodiments, the radius of curvature of the crowned portion 210*a* can be at least about 0.4 inches. Such embodiments are well suited to control compressive loads at interfaces to provide a uniform load distribution along the rail 128. In other embodiments, the radius of curvature can be in a range of about 0.04 inches to about 1.0 inches. Other radii can also be used, if needed or desired.

In some embodiments, the non-planar surface 220*a* has a partially circular profile, partially elliptical profile, nonplanar profile, or the like. For example, the non-planar surface 220*a* can also be an arcuate surface, as illustrated. The crowned portion 210*a* can be crowned with respect to a generally straight axis and includes a first outer portion, a second outer portion, and an inner portion between the first outer portion and the second outer portion. The inner portion has a height that is greater than the height of the first outer portion and the height of the second outer portion.

Figure 6:
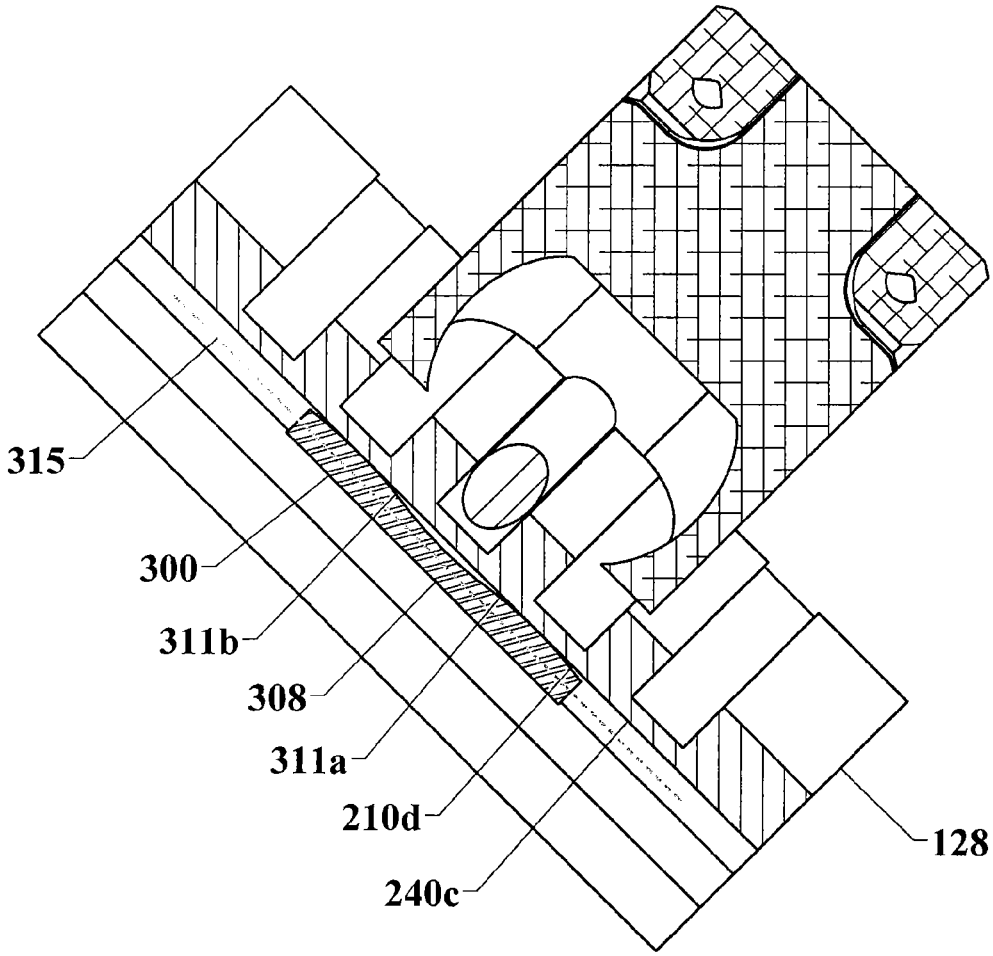
FIG. 6 is a cross-sectional view of the assembly of FIG. 4 taken along a line 6-6 of FIG. 4.

FIG. 6 shows the mounting clamp 200 engaging the mounting rail 128. To securely grip the rail 128, a nut 309 (see FIG. 4) can be torqued down to apply a force to a central region 308 of a clamp member 300. When the rail 128 is compressed, the crowned portions 210 bear against the mounting rail 128 to provide generally uniform loads. In this manner, more uniform loads can be applied as compared to conventional clamps.

With continued reference to FIG. 6, the crowned portion 210*d* extends longitudinally along the mounting rail 128. The crowned portion 210*d* includes a first portion 311*a* that presses against the mounting rail 128 and a second portion 311*b* that pushes against another portion of the mounting rail 128. The first and second portions 311*a*, 311*b* are longitudinally crowned with respect to a long axis 315. One or both of the first and second portions 311*a*, 311*b* can have a variable height with respect to the long axis 315 to provide relatively large contact areas to manage stresses in the rail 128. Central regions of the first and second portions 311*a*, 311*b* can protrude into the rail channel 129. Thus, crowned portion 210*d* can be crowned transversely and/or longitudinally with respect to a mounting rail channel 129 of the scope mounting clamp.

Figure 7:
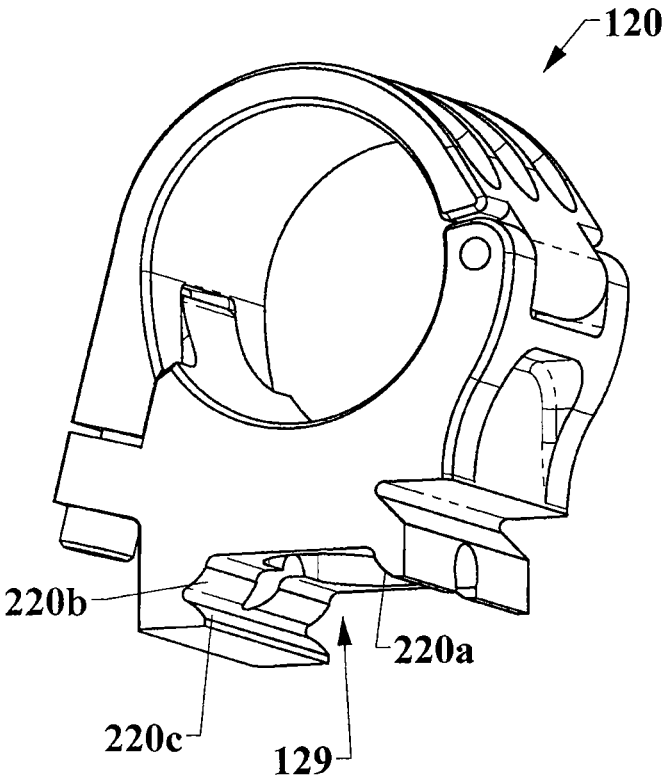
FIG. 7 is a perspective view of a mounting clamp, in accordance with one embodiment.
Figure 8:
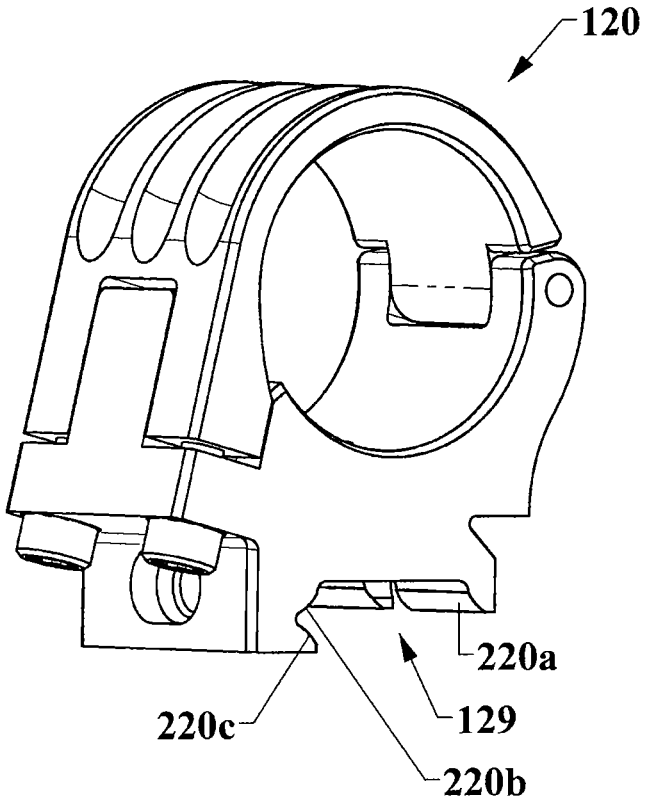
FIG. 8 is another perspective view of the mounting clamp of FIG. 7.

FIGS. 7 and 8 show clamp surfaces 220*a*, 220*b*, 220*c* (collectively 220). Each of the clamp surfaces 220 extends along the rail channel 129.

Figure 10:
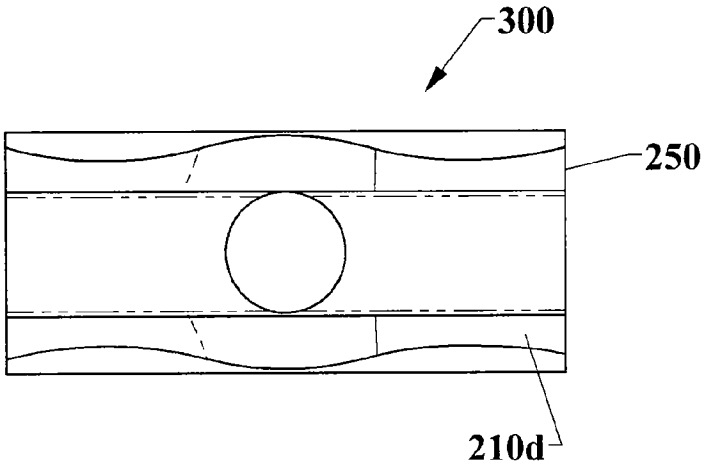
FIG. 10 is a side elevational view of the clamp member of FIG. 9.
Figure 11:
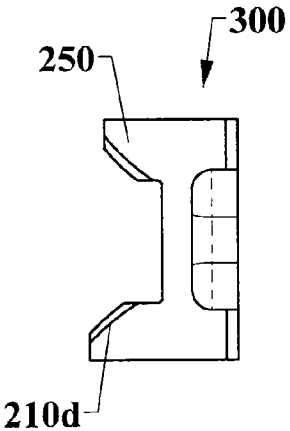
FIG. 11 is a front elevational view of the clamp member of FIG. 9.
Figure 9:
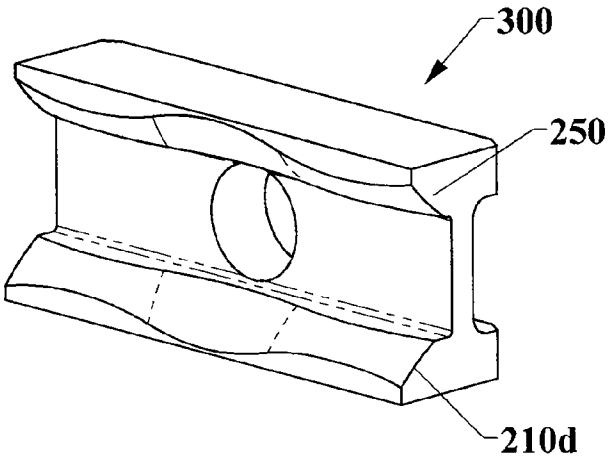
FIG. 9 is a perspective view of a clamp member, in accordance with one embodiment.

FIGS. 9-11 show the clamp member 300 including the spaced-apart crowned portions 210*d*, 250. The crowned portions 210*d*, 250 engage the rail 128 and a main body 252 of the clamp 120, respectively, as shown in FIG. 5.

Referring again to FIGS. 4 and 5, the crowned portions 210*a*, 210*d* cooperate to hold one side of the rail 128 while the crowned portions 210*b*, 210*c* hold the other side of the rail 128. The crowned portion 250 engages the main body 252 of the clamp 120 (see FIG. 5). The crowned portion 250 can bear against an engagement surface 260 of the main body 252 to allow pivoting of the clamp member 300 such that the crowned portions 210*a*, 210*b*, 210*c*, 210*d* contact corresponding surfaces 240*a*, 240*b*, 240*c*, 240*d* of the rail 128. As the clamp member 300 is moved towards the rail 128, the applied loads can be increased. The crowned portions 210 slide along and bear against the respective surfaces 240, and can also flatten out to help distribute those loads. As such, the clamp 120 can securely grip a wide range of different types of rails 128, even if the rail 128 is undersized or oversized with respect to the clamp 200.

Figure 12:
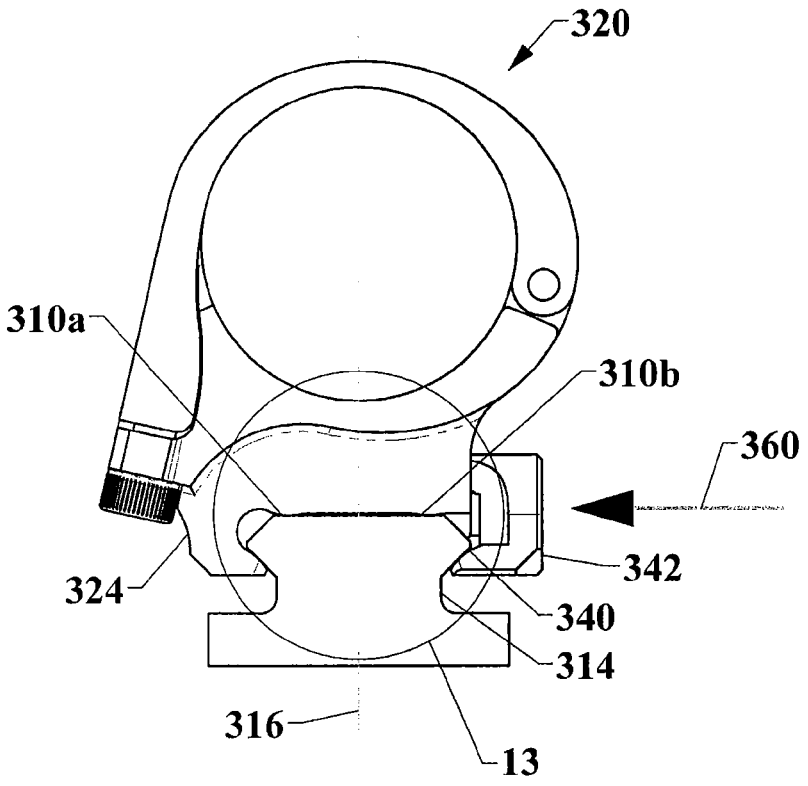
FIG. 12 is a front elevational view of a mounting clamp attached to a mounting rail according to another embodiment.
Figure 13:
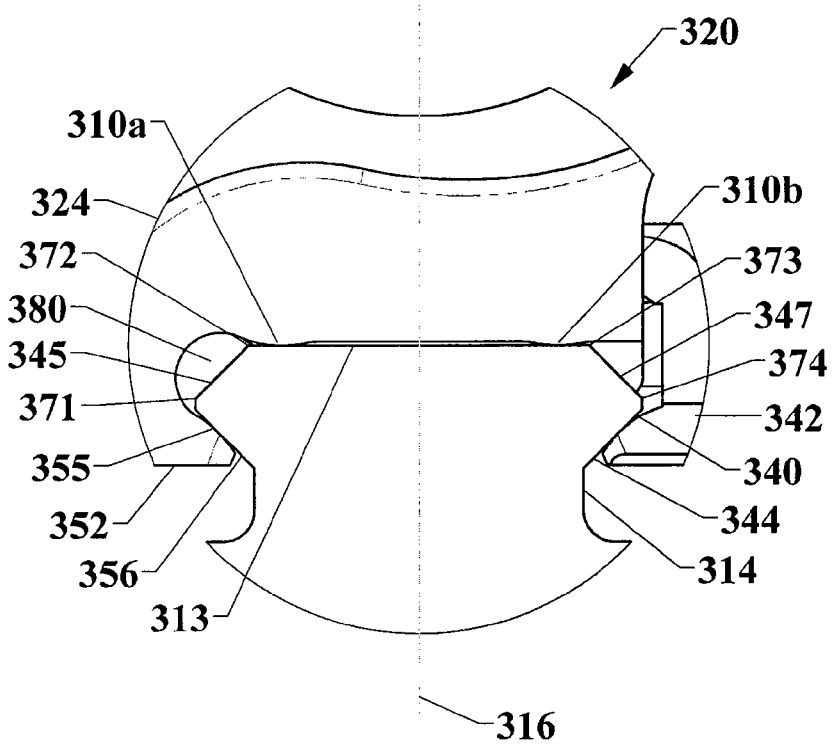
FIG. 13 is a detailed view of a portion of the mounting clamp and a portion of the mounting rail of FIG. 12.

FIGS. 12 and 13 show a mounting clamp 320 that includes a main body 324 having crowned portions 310*a*, 310*b* positioned to contact an upper surface 313 of a rail 314. The crowned portions 310*a*, 310*b* are positioned on either side of a center plane 316 of the rail 314. The number, spacing, and configurations of the crowned portions can be selected based on the desired clamp forces.

A crowned portion 340 of a clamp member 342 contacts a lower rail surface 344 of the rail 314. An abutment 352 has a crowned portion 355 that contacts a lower rail surface 356. The clamp 320 can be securely fixed to the rail 314 without contacting the upper rail surfaces 345, 347. When the clamp member 342 is moved inwardly (indicated by an arrow 360 of FIG. 12), the crowned portion 340 can slide along the lower rail surface 344 towards the rail center plane 316. A side edge 347 of the rail 314 is pushed between the crowned portions 310*b* and 340. As the applied force is increased, the pressure between the crowned portions 310*a*, 310*b*, 340, 355 and the rail 128 can be increased without producing high stresses at the rail edges 371, 372, 373, 374. The rail edges 371, 372 are held in a gap 380 (illustrated as a U-shaped gap in FIG. 13) between the crowned portions 310*a*, 355.

Figure 14:
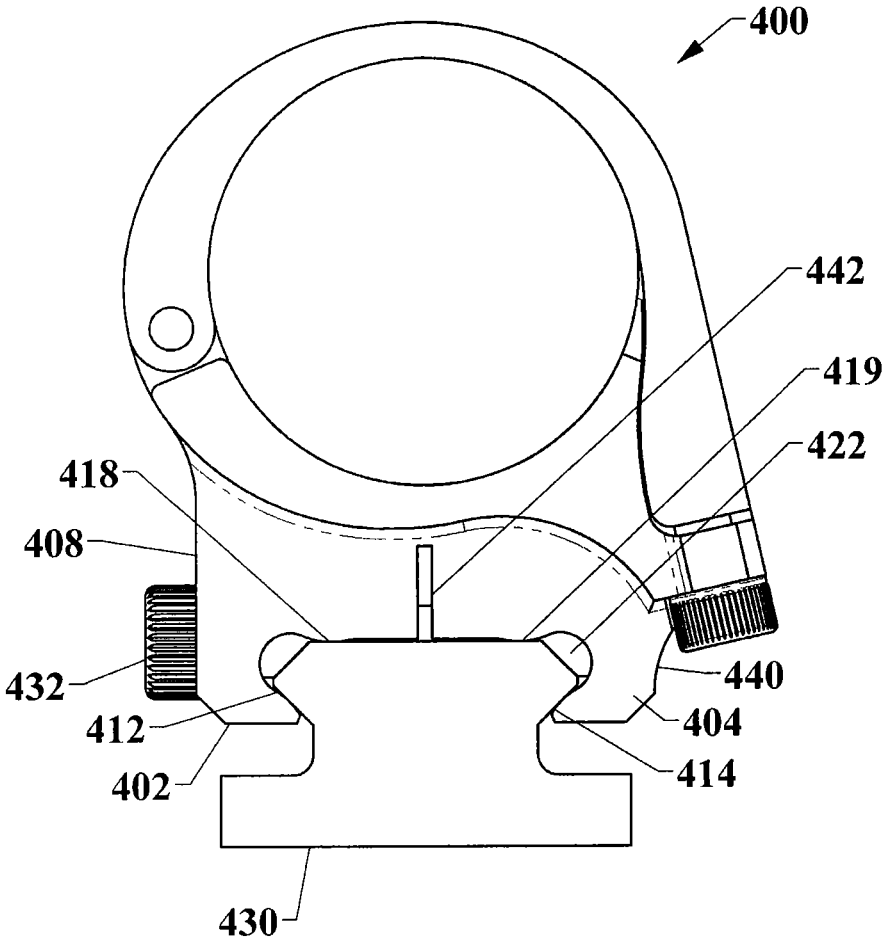
FIG. 14 is a front elevational view of a mounting clamp attached to a mounting rail according to another embodiment.

FIG. 14 shows a mounting clamp 400 that includes a pair of clamp members 402, 404 integrally formed with a main body 408. The clamp member 402 includes a crowned portion 412. The clamp member 404 includes a crowned portion 414. The main body 408 includes crowned portions 418, 419. The crowned portions 412, 414, 418, 419 define, at least in part, a mounting rail channel 422.

To couple the mounting clamp 400 to a rail 430, a fastener 432 can be used cause a clamp portion 440 to collapse inwardly. An elongated slot 442 allows the clamp members 402, 404 of the clamp portion 440 to move towards one another to collapse the clamp portion 440. In this manner, the clamp members 402, 404 can cooperate to grip the rail 430.

Unless the context requires otherwise, throughout the specification and claims which follow, the word "comprise" and variations thereof, such as "comprises" and "comprising," are to be construed in an open, inclusive sense, that is as "including, but not limited to."

It should be noted that, as used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The embodiments, mounting clamps, features, systems, devices, methods and techniques described herein may, in some embodiments, be similar to any one or more of the embodiments, mounting clamps, features, systems, devices, materials, methods and techniques described in U.S. patent application Ser. No. 12/510,973 and U.S. Provisional Patent Application 61/294,407. U.S. patent application Ser. No. 12/510,973 filed Jul. 28, 2009 is incorporated herein by reference in its entirety. In addition, the embodiments, features, systems, devices, materials, methods and techniques described herein may, in certain embodiments, be applied to or used in connection with any one or more of the embodiments, features, systems, devices, materials, methods and techniques disclosed in the above-mentioned U.S. patent application Ser. No. 12/510,973 and U.S. Provisional Patent Application 61/294,407. For example, the mounting clamps and this features disclosed in U.S. patent application Ser. No. 12/510,973 may incorporate the embodiments disclosed herein.

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A scope mounting clamp coupled to a mounting rail of a firearm, comprising:

a clamp member including a first crowned portion; and a main body including a plurality of second crowned portions, the clamp member and the main body defining a mounting rail channel, the mounting rail of the firearm is positioned in the mounting rail channel, the first crowned portion and the second crowned portions surrounding the mounting rail channel such that curved surfaces of the first crowned portion and the second crowned portions are spaced apart from all longitudinally extending edges of the mounting rail located between flat surfaces of the mounting rail contacted by the first and second crowned portions.

2. The scope mounting clamp of claim 1, wherein the first crowned portion and the second crowned portions are spaced apart to define edge receiving gaps positioned to receive the longitudinally extending edges of the mounting rail of the firearm.

3. The scope mounting clamp of claim 1, wherein at least one of the first crowned portion and the second crowned portions is sufficiently curved so as to deform to keep stresses in the mounting rail to which the scope mounting clamp is coupled below a yield strength of the mounting rail.

4. The scope mounting clamp of claim 1, wherein the clamp member is movable with respect to an abutment portion of the clamp, the abutment portion includes one of the second crowned portions.

5. The scope mounting clamp of claim 1, wherein the first crowned portion and one of the second crowned portions are positioned to contact one side of the mounting rail and a pair of the second crowned portions is positioned to contact another side of the mounting rail.

6. The scope mounting clamp of claim 1, wherein the first crowned portion has a radius of curvature of at least 0.04 inches.

7. The scope mounting clamp of claim 1, wherein at least one of the second crowned portions has a radius of curvature of at least 0.04 inches.

8. The scope mounting clamp of claim 1, wherein the first and second crowned portions extend longitudinally along the mounting rail when the mounting rail is positioned in the mounting rail channel.

9. The scope mounting clamp of claim 1, wherein at least one of the first and second crowned portions includes a first outer portion, a second outer portion, and an inner portion between the first outer portion and the second outer portion, the inner portion has a height that is greater than a height of the first outer portion and a height of the second outer portion.

10. The scope mounting clamp of claim 1, wherein at least one of the first and second crowned portions defines an arcuate surface that bears against a flat surface of a mounting rail during use.

11. The scope mounting clamp of claim 1, wherein at least one of the first and second crowned portions includes a region that is curved and positioned to contact the mounting rail.

12. The scope mounting clamp of claim 1, wherein a curved central region of one of the first and second crowned portions protrudes into the mounting rail channel.

13. A system, comprising:

a mounting rail for a firearm; and a scope mounting clamp including a first convex curved portion and a second convex curved portion, the first convex curved portion contacting a first surface of the mounting rail, and the second convex curved portion contacting a second surface of the mounting rail such that a first contact interface between the first convex curved portion and the first surface and a second contact interface between the second convex curved portion and the second surface are both spaced apart from all longitudinal edges of the mounting rail adjacent to the first and second surfaces;

wherein the scope mounting clamp further includes a third convex curved portion that contacts a third surface of the mounting rail;

a third contact interface between the third convex curved portion and the third surface of the mounting rail;

a fourth convex curved portion that contacts a fourth surface of the mounting rail; and a fourth contact interface between the fourth convex curved portion and the fourth surface of the mounting rail, wherein the third contact interface and the fourth contact interface are spaced apart from the longitudinal edges of the mounting rail adjacent to the third and fourth surfaces of the mounting rail.

14. The system of claim 13, wherein a longitudinal edge of the mounting rail located between the first and second surfaces is spaced apart from the scope mounting clamp and positioned in an edge receiving gap between the first and second convex curved portions.

15. The system of claim 13, wherein the mounting rail is a dovetail mounting rail.

16. The system of claim 13, wherein the scope mounting clamp is spaced apart from all longitudinal edges of the mounting rail.

* * * * *

UNITED STATES PATENT AND TRADEMARK OFFICE

CERTIFICATE OF CORRECTION

PATENT NO. : 8,572,885 B2
APPLICATION NO. : 13/005480
DATED : November 5, 2013
INVENTOR(S) : Theodore Karagias It is certified that error appears in the above-identified patent and that said Letters Patent is hereby corrected as shown below:

On the title page, in item (56), in column 2, under "U.S. Patent Documents", line 4, delete "Kesseiring" and insert -- Kesselring --, therefor.

Signed and Sealed this
Ninth Day of February, 2016

Michelle K. Lee

Michelle K. Lee
*Director of the United States Patent and Trademark Office*